US011629419B2

(12) United States Patent
Meier

(10) Patent No.: US 11,629,419 B2
(45) Date of Patent: Apr. 18, 2023

(54) ANODE FOR ALUMINIUM ELECTROLYSIS

(71) Applicant: R + D CARBON LTD, Granges (CH)

(72) Inventor: Markus Meier, Steffisburg (CH)

(73) Assignee: R + D CARBON LTD, Granges (CH)

( * ) Notice: Subject to any disclaimer, the term of this patent is extended or adjusted under 35 U.S.C. 154(b) by 178 days.

(21) Appl. No.: 17/414,583

(22) PCT Filed: Dec. 17, 2019

(86) PCT No.: PCT/EP2019/085715
§ 371 (c)(1),
(2) Date: Jun. 16, 2021

(87) PCT Pub. No.: WO2020/127315
PCT Pub. Date: Jun. 25, 2020

(65) Prior Publication Data

US 2022/0056605 A1 Feb. 24, 2022

(30) Foreign Application Priority Data

Dec. 19, 2018 (CH) ..... 1569/18

(51) Int. Cl.
*C25C 3/08* (2006.01)
*C25C 3/12* (2006.01)
*C25C 3/16* (2006.01)

(52) U.S. Cl.
CPC . *C25C 3/12* (2013.01); *C25C 3/16* (2013.01)

(58) Field of Classification Search
CPC ..... C25C 3/12; C25C 3/16
See application file for complete search history.

(56) References Cited

U.S. PATENT DOCUMENTS

| | | | |
|---|---|---|---|
| 4,342,637 | A | 8/1982 | Withers et al. |
| 4,824,543 | A | 4/1989 | Peterson et al. |
| 2007/0045104 | A1 | 3/2007 | Wang et al. |

FOREIGN PATENT DOCUMENTS

WO WO 2018/058204 A1 4/2018

OTHER PUBLICATIONS

International Search Report, issued in PCT/EP2019/085715, dated Feb. 14, 2020.
Written Opinion of the International Searching Authority, issued in PCT/EP2019/085715, dated Feb. 14, 2020.

*Primary Examiner* — Zulmariam Mendez
(74) *Attorney, Agent, or Firm* — Birch, Stewart, Kolasch & Birch, LLP

(57) ABSTRACT

An anode, in particular an anode for the use in aluminium electrolysis cells, includes an anode body with a first stub hole for the insertion of a stub for the connection with a voltage source. The anode includes at least a first aluminium core and a second aluminium core that are arranged inside the anode body for the connection with the voltage source. A first distance between the first aluminium core and the bottom of the anode is different from a second distance between the second aluminium core and the bottom of the anode.

16 Claims, 2 Drawing Sheets

ANODE FOR ALUMINIUM ELECTROLYSIS

TECHNICAL FIELD

The invention relates to an anode, in particular an anode for the use in aluminium electrolysis cells, comprising an anode body with a first stub hole for the insertion of a stub for the connection with a voltage source, the anode comprising at least a first aluminium core and a second aluminium core that are arranged inside the anode body for the connection with the voltage source.

BACKGROUND ART

When a new prebaked anode is set in the electrolysis cell, a crust of frozen electrolyte bath is formed on the bottom surface of the anode that is immersed in the bath. This crust is molten in the first day after setting in the pot and electrical current starts to pass through the anode.

According to equation (1)

$$U(\text{Anode}) = \frac{SER(\text{Anode}) * L * I}{A}$$

where

U(Anode): Voltage drop

SER(Anode): Specific electrical resistance of anode

L: Height of the anode minus half of stub hole depth

I/A: Current density the voltage drop U(Anode) can be calculated.

For example, with SER(Anode)=55 μΩm, L=0.6 m and I/A=0.8 A/cm$^2$, the voltage drop U(anode) is about 260 mV in the early stage of the anode life. During the electrolysis process, the anode is consumed wherewith the height is reduced continuously. Due to the reduction of the height of the anode, the voltage drop is reduced also.

As the anode is consumed, the voltage drop in the anode is continuously reduced to about 50 mV due to the decreasing height of the anode to about 0.2 m. The resulting height will be about L=0.15 m. Due to the higher temperature of the anode with reduced height, the SER(Anode) meanwhile decreases to about 44 μΩm.

In order to provide for an efficient electrolysis process, the voltage drop U(Anode) should be as low as possible, also in the early stage of the anode life.

A further problem in the electrolysis process is to achieve an optimized current density distribution. However, due to the consumption of the anode, the dimension of the anode changes during the electrolysis process, wherewith the current density distribution changes.

SUMMARY OF THE INVENTION

It is the object of the invention to create an anode pertaining to the technical field initially mentioned, that provides for a reduced voltage drop in particular in an early stage of the anode life. Further, it is an object of the invention to create an anode, wherewith an optimized current density distribution can be achieved.

The solution of the invention is specified by the features of claim 1. According to the invention a first distance between the first aluminium core and the bottom of the anode is different from a second distance between the second aluminium core and the bottom of the anode.

In the early stage of the anode life, the anode bottom is immersed in the electrolyte bath. In this stage, the first aluminium core is at a first distance of the bottom of the anode and the second aluminium core is at a second distance of the bottom of the anode. Without loss of generality, the first distance is less than the second distance. The current will flow from the voltage source via the stub to the first aluminium core, since the first aluminium core is closer to the bottom of the anode than the second aluminium core. Since the first aluminium core is closer to the bottom of the anode than the stub, the voltage drop U(Anode) can be reduced significantly.

As the anode is consumed by the electrolysis process, the first distance L1 between the first aluminium core and the bottom of the anode as well as the second distance L2 between the second aluminium core and the bottom of the anode are decreasing. With the consumption of the electrode, the lower end of the first aluminium core is reached by the electrolyte bath, the molten aluminium core will discharge from the anode. The current will now flow to the second aluminium core that is at a distance of L2-L1 from the bottom of the anode. At this moment, the second aluminium core is still closer to the bottom of the anode than the stub, wherewith the voltage drop is still reduced significantly.

For the skilled in the art it is clear, that further aluminium cores can be arranged in the anode, wherewith more than two distances between an aluminium core and the bottom of the anode, that are different to each other, can be achieved. In particular, there can be 4, 6, 10 or more different distances, wherewith the voltage drop can be further optimized. The main goal is to achieve at every stage of the electrolysis process a smallest possible distance between an aluminium core and the bottom of the anode.

However, while the ideal anode comprises many aluminium cores, the real anode will have less aluminium cores in order to control the costs for producing the anode. The benefit of the reduced voltage drop should be higher than the additional cost for arranging the aluminium cores in the anode. Therewith, the optimized anode will probably comprise about 4 to 20, in particular about 6 to 14 aluminium cores. However, more than 20 cores are also possible, in particular, if the costs for the production of such anodes is not too high. While the anode comprises N aluminium cores, there will be between 2 to N different distances between the aluminium cores and the bottom of the anode. In particular, there will be several groups of aluminium cores that differ to each other in the length, while all the aluminium cores of one group have the same length and/or the same distance to the bottom of the anode. Alternatively, up to all of the aluminium cores could be arranged such that the distances to the bottom of the anode will be different to each other. In a further embodiment, other distribution of length of aluminium cores can be chosen in order to optimize the voltage drop.

Preferably the aluminium cores are arranged equidistant around a stub hole. In particular, an anode can comprise more than one stub hole, for example 2, 3, 4, 5, 6 or more. In this case, the concentration of aluminium cores between the stub holes could be less than outside. The aluminium cores can be arranged in near proximity to the stub hole, in particular, tangential to the stub hole. In a further embodiment, between the stub hole and the aluminium cores can be a radial distance, that is bridged e.g. by cast iron or the like. In a further embodiment, the aluminium cores are arranged uniformly distributed over the whole anode. The skilled person can determine the ideal arrangement of the aluminium cores in the anode also by calculation or by doing some experiments.

The total voltage drop U (Total) of the anode equipped with an aluminium core is given by equation (2):

$$U(\text{Total})=U(\text{Al})+U(\text{Anode})$$

where:

U(Al): Voltage drop by the aluminium core;

U(Anode): Voltage drop of anode underneath the aluminium core;

U(Total): Total voltage drop.

For example, while in an anode without aluminium core, with SER(Anode)=55 μΩm, L=0.6 m and I/A=0.8 A/cm$^2$, the voltage drop U(anode) is about 260 mV in the early stage of the anode life, the voltage drop for an anode comprising the aluminium core can be reduced by about 120 mV to about 140 mV in the early stage of the anode life.

However, with the progressing anode life, the gained difference in voltage drop subsequently decreases. The average gain in voltage drop is estimated to be one third of the initial gain, i.e. 40 mV over the entire anode life. However, the gained voltage drop could be even higher, in particular, more than 80 mV, for example about 100 mV.

There are three options to take advantage of the gained average voltage drop:

Option 1: Reduction in energy consumption

Option 2: If additional energy is available, increase in productivity by raising current so that the old voltage is obtained Option 3: If no additional energy is available, increase of current so that the original energy input is maintained With option 1, and an assumed gained voltage drop of 40 mV, the reduction of energy consumption is 0.13 MWh/tAl. With option 2, the current can be increased by 1.5%. With option 3, the current can be increased by 0.5%.

When the anode is set into the electrolysis cell, a heat wave penetrates from the bottom and side surfaces into the bulk of the anode. When the crust of frozen electrolyte bath underneath the anode is molten, the current will preferentially pass from the stubs via cast iron through the aluminium bars and from there through the remaining bottom of the anode.

The process heat from the electrolysis cell will increase the temperature in the bulk of the anode above the melting point of aluminium (i.e. 660° C.), hence the aluminium will melt, but continue to pass the current.

As the anode is consumed by the electrolysis process, the remaining portion below the anode decreases continuously until the tip of the deepest hole filled with aluminium, in particular the first aluminium core is reached. When this happens, the liquid aluminium will pour out of this hole. Accordingly, the current will pass through the remaining holes filled with aluminium having a shorter depth. This will repeat until the tip of all holes is reached and all aluminium is poured out. The current will then pass through the remainder of the anode.

As mentioned above, by using the aluminium cores in the anode, the distribution of the current density during the electrolysis process can be optimised. Therefore, two or more aluminium cores can be dimensioned and arranged in the anode such that an optimized distribution of the current density is established.

Preferably a length of the first aluminium core is different from a length of the second aluminium core. Therewith, in an anode comprising a cuboid like shape, in particular the shape of a cuboid, all the aluminium cores can be arranged in the anode with the same distance to a top of the anode. Therewith, the electric connection to the voltage source can be established in a simple and standardized way for each aluminium core. However, the length of both, the first and the second, aluminium cores can be equal.

Preferably the first aluminium core is arranged in a first blind hole of the anode body and, preferably, the second aluminium core is arranged in a second blind hole of the anode body, wherein the first aluminium core and the second aluminium core are in particular parallel to each other. Therewith, the aluminium core can be easily built by a casting process. In alternative embodiments the aluminium core can be arranged in a trough hole.

Preferably the first aluminium core and the second aluminium core are arranged rectangular to the bottom of the anode. In variants, in particular, if the bottom of the electrode is not planar, the aluminium cores could be arranged in another angle to the bottom of the anode.

Preferably the anode has a cuboid like outer shape, in particular the outer shape of a cuboid. Therewith, the anode can be manufactured in a simple manner. However, the skilled person is aware of several other outer shapes, useful for special electrolysis processes.

After forming and cooling of the green anode, the conical holes are sealed with a combustible plug to prevent packing material from entering the conical hole during baking of the anodes.

After baking, the conical or cylindrical holes are filled with liquid or solid aluminium up to the level where the diameter is enlarged (see below).

Preferably the first blind hole is conical or cylindrical. In particular, the blind hole can be made by a forming process or by a drilling process. If built by a drilling process, a cylindrical hole is preferred. If built by a forming process, a conical hole is preferred.

Preferably the first blind hole comprising the first aluminium core is sealed by a seal, in particular by a seal comprising cast iron. Therewith the aluminium core can be connected to the voltage source via the stub. In a first step, the stub can be inserted into the stub hole and the aluminium core can be arranged in the blind hole. As a second step, iron is casted into the stub (in the gap between the stub and the stub hole) where simultaneously the cast iron connects the aluminium core on the blind hole and seals the blind hole. Therewith the electric connection and the sealing of the blind hole can be made in one step.

The area of enlarged diameter at the top of the conical or cylindrical hole is filled with cast iron. When the liquid aluminium pours out at the bottom of the hole, the cast iron on top of the hole acts as a seal to prevent a chimney effect in the empty hole.

The anodes are mated with the yoke assembly in the rodding station according to the standard procedure and liquid cast iron is poured in the gap between the stub holes and the stubs. By doing so, the liquid cast iron flows also via inclined notch into the upper part of the hole with enlarged diameter and fuses with the aluminium below. To enhance the cast iron—aluminium connection, the aluminium may as an option be prepared with a hole on top that is then filled with the liquid cast iron.

As an alternative to the liquid aluminium, solid aluminium bars may be inserted into the conical or cylindrical holes.

Preferably, close to the anode head, the conical or cylindrical holes have an enlarged diameter. Therewith, an improved sealing of the blind hole can be achieved.

Preferably an opening of the first blind hole is adjacent to an opening of the first stub hole. Therewith, the recycling process can be made more efficient, since the cast iron connection between the stub hole and the blind hole is short and therefore more stable. In variants, the opening of the first blind hole can be at a distance to the opening of the first stub hole.

Preferably a rotational axis of the first blind hole is parallel to a rotational axis of the first stub hole. Therewith, in the electrolysis process, the stub is oriented parallel to the aluminium core. In particular, the rotational axis of the first blind hole is in the electrolysis process preferably perpendicular to the surface of the molten cryolite/aluminium. However, the first blind hole may also be oriented otherwise. The orientation depends on the dimension of the anode, in particular if an optimized current density distribution is aimed.

Preferably the rotational axis of the first blind hole is located at a distance to the rotational axis of the first stub hole, wherein the distance is less than a double of a diameter of the first stub hole, in particular less than the diameter of the first stub hole. However, the distance can also be larger than the double of the diameter of the first stub hole. The placement in the anode depends on the dimension of the anode, in particular, if an optimized current density distribution is aimed.

Preferably a first notch connects the first stub hole with the first blind hole. Therewith, the casting process for sealing the blind hole and connecting the aluminium core with the voltage source can be simplified. However, the notch can also be omitted.

Preferably, the first notch is inclined from the first stub hole to the first blind hole. Therewith, the cast iron will flow into the opening of the blind hole by gravity. However, the inclination can be turned from the blind hole to the stub or can be omitted too.

Preferably, the aluminium core comprises a cavity, in that the cast iron can flow in order to achieve a tighter connection with the seal. However, the cavity can also be omitted.

Preferably, at least a second aluminium core is arranged inside the anode body in a second blind hole. Therewith, the voltage drop can be further reduced. More aluminium cores arranged in the anode body provides for a better reduction of the voltage drop. Further, the distribution of the current density can be optimized in an improved manner.

Up to 18 conical holes are formed in the green anode body near the stub holes. As an alternative to the formed conical holes, up to 18 cylindrical holes may be machined after baking of the anodes. However, more than 18 blind holes can be formed in the anode body. The number of blind holes depends on the dimension of the anode body and number of stub holes.

The number of conical or cylindrical holes depends on the size of the anode and the number of stub holes.

The conical or cylindrical blind holes have different depths up to 650 mm and different diameters up to 100 mm. The dimension of the blind hole depends on the dimension of the anode body. By adapting the diameter of the blind holes, the anode current distribution may be optimized. However, the blind holes can have larger depths and/or larger diameters.

Preferably, the second blind hole is connected to the first stub hole by a second notch. In variants, the second blind hole can be connected to the first blind hole by a second notch.

Preferably, the first blind hole is longer than the second blind hole. In variants, the blind holes can have the same length. Preferably, the first blind hole is part of a first group of blind holes having the same length and/or the same distance to the bottom of the anode.

Preferably, the second blind hole is part of a second group of blind holes having the same length and/or the same distance to the bottom of the anode.

Preferably, the first blind hole has a smaller diameter than the second blind hole. When the tip of the first blind hole reaches the melt during the electrolysis process, the aluminium in the first blind hole will pour out. Since the remaining second blind hole with the shorter length has a larger diameter, it can compensate the loss of the aluminium core of the first blind hole. However, the diameter can also be chosen differently.

Preferably, at least one of the following parameters are balanced in order to achieve an optimized current density distribution when used in an aluminium electrolysis process:

a diameter of an aluminium core;

a length of an aluminium core;

the arrangement of the aluminium core in the anode.

Preferably, the anode can comprise at least a second stub hole. In particular, the anode can comprise several stubs arranged in one or more rows etc. In variants, the anode can comprise only one stub hole. Preferably, every stub is electrically connected to at least one aluminium core. In variants, one or more of the stubs is not electrically connected to an aluminium core. Preferably, each aluminium core is electrically connected to exactly one stub. However, an aluminium core can also be electrically connected to more than one stub.

Preferably, the length of the longest aluminium core is between 60% and 95%, in particular between 70% and 80% of a height of the anode body. In variants, the length of the longest aluminium core can be longer than 95% or less than 60% of the height of the anode body.

Preferably, the length of the shortest aluminium core is between 30% and 60%, in particular between 40% and 50% of a height of the anode body. In variants, the length of the shortest aluminium core can be longer than 60% or less than 30% of the height of the anode body.

In a method for the manufacture of an anode comprising an anode body with a stub hole for the insertion of a stub for the connection with a voltage source, an aluminium core is arranged inside the anode body for the connection with the voltage source.

Preferably, after providing a blind hole in the anode body, the aluminium core is arranged in the blind hole.

Preferably, the blind hole and the stub hole are built in one step by a forming press. Alternatively, the blind hole is built by a drilling process.

Preferably, the blind hole is filled with molten aluminium, preferably with molten aluminium having the same quality as produced by the smelter where the anode is used. Alternatively, also different qualities of aluminium can be used. Preferably, the blind hole is filled with molten aluminium having high purity, more preferably with a purity of more than 99% by weight. In variants, the blind hole is filled with an aluminium bar, preferably with an aluminium bar having high purity, more preferably with a purity of more than 99% by weight. Further, the blind holes can be filled by aluminium granulates and heated to the melting point. Alternatively, the purity of aluminium can be less than 99% by weight.

In a method for the production of aluminium by aluminium electrolysis, an aluminium core of the anode is electrically connected to a voltage source.

In an arrangement comprising an anode and a stub, a stub is inserted into the stub hole of the anode body and the stub is in electrical contact with the aluminium core.

Other advantageous embodiments and combinations of features come out from the detailed description below and the entirety of the claims.

BRIEF DESCRIPTION OF THE DRAWINGS

The drawings used to explain the embodiments show.

In the figures, the same components are given the same reference symbols.

PREFERRED EMBODIMENTS

Figure 1A:
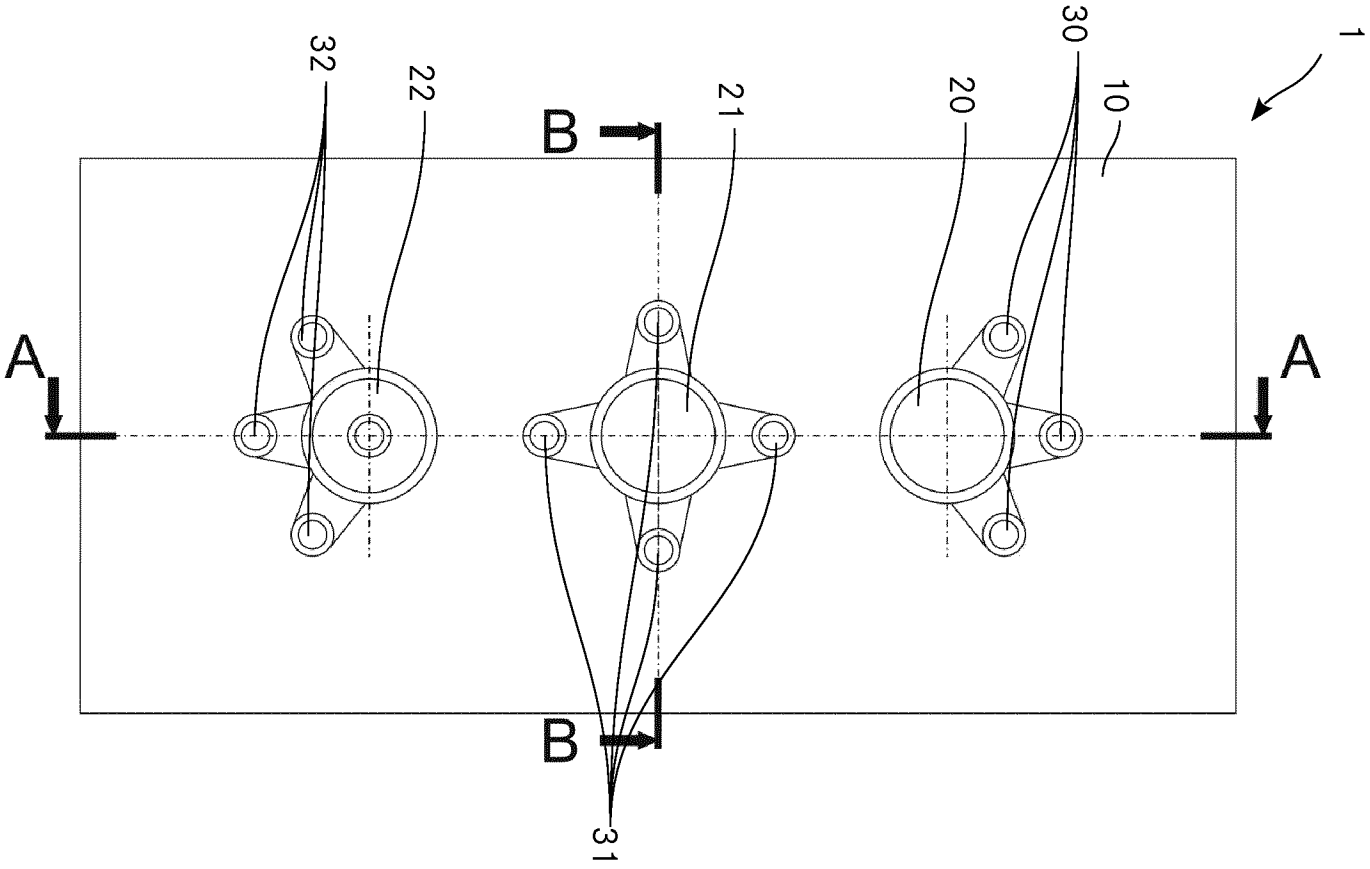
FIG. 1*a* a top view on an example of an anode.

FIG. 1*a* shows a top view on an example of an anode 1. The anode 1 is box-shaped. The anode 1 has a height of 650 mm, a length of 1625 mm and a width of 780 mm. It comprises three stub holes 20, 21, 22 in a row, having a diameter of 190 mm. The stub (not shown) has a diameter of 160 mm. The cap between the stub and the stub hole is filled with liquid cast iron.

Further, connected by a notch, each stub hole 20, 21, 22 is connected to a blind hole. Stub hole 20 is connected to three blind holes 30, stub hole 21 is connected to four blind holes 31 and stub hole 22 is connected to three blind holes 32.

Each blind hole 30, 31, 32 comprises an enlarged diameter at a top of the anode 1. In a first step, the blind holes 30, 31, 32 are filled with aluminium, in particular with liquid aluminium or with solid aluminium bars. Then, the stubs are arranged in the stub holes 20, 21, 22. The gaps between the stub and the stub holes 20, 21, 22 are then filled with liquid cast iron. The iron flows through the notches into the area of the blind holes 30, 31, 32 with enlarged diameter. Therewith an electric connection between the stub and the aluminium core is established. Further, the blind holes 30, 31, 32 are sealed.

Figure 1B:
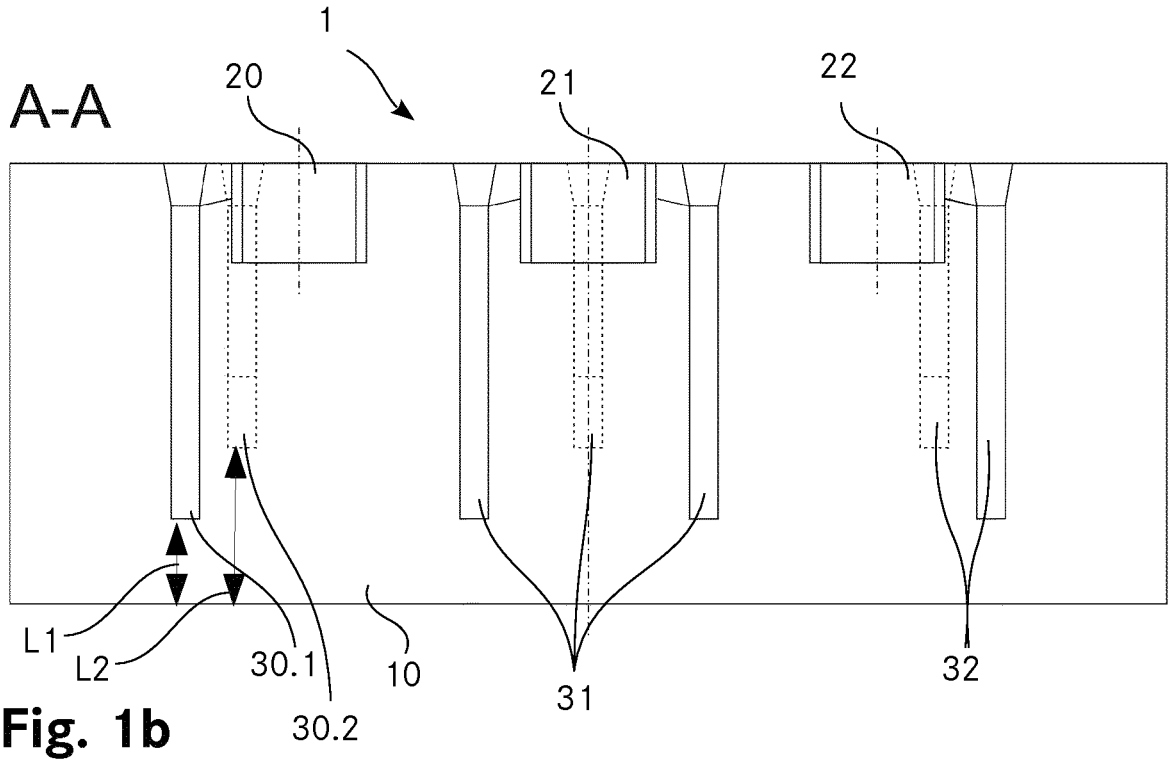
FIG. 1*b* a sectional view of the FIG. 1*a*, along the line A-A.

FIG. 1*b* shows a sectional view of the FIG. 1*a*, along the line A-A. As can be seen, the length of the blind holes 30.1 and 30.2 are different. The blind hole 30.1 has a distance to the bottom of the anode 1 of L1, while the blind hole 30.2 has a distance to the bottom of the anode 1 of L2. During the consumption of the anode 1, the bottom of the blind hole 30.1 will be reached, wherewith the aluminium core (not shown) will flow out of the hole 30.1. The current will now flow to the second aluminium core in the stub hole 30.2. The distance of the second stub hole 30.2 to the bottom of the electrode will be at this stage L2-L1. Also, the length of the blind holes 31 and the length of the blind holes 32 are different. During the electrolysis process the current will pass mostly to the longest aluminium cores since there is the lowest resistance. The height of the anode 1 is decreasing. First, the tip of the longest blind hole is reached, wherewith the aluminium will pour out of the blind hole. Since the top of the blind hole is sealed, chimney effect can be avoided. Later, the other aluminium cores will be reached to and pour out. Finally, the current will pass by the stub through the remaining part of the anode 1.

Figure 1C:
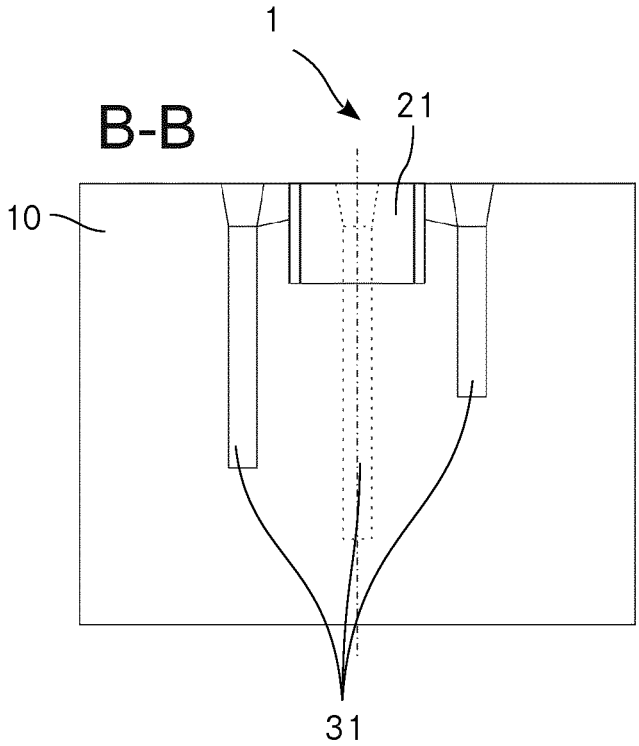
FIG. 1*c* a sectional view of the FIG. 1*a*, along the line B-B.

FIG. 1*c* shows a sectional view of the FIG. 1*a*, along the line B-B. It can be seen, that the blind holes 31 related to the stub hole 21 having three different lengths. They have a length of 500 mm, 400 mm and 300 mm.

In order to achieve an optimized current distribution during the electrolysis process, the number and position of the stub holes, the number and position of the blind holes and the aluminium cores as well as the dimension of the stub holes and the blind holes can be optimized.

However, in other embodiments, the anode 1 can have other shapes known to the skilled in the art. The blind holes can have different diameters. The length of the blind holes can vary. The number of blind holes per stub hole can vary. Also, the number of stub holes in the anode 1 can vary.

In summary, it is to be noted that an anode for the production of aluminium by an electrolysis process is established, wherewith at least in an early stage of the anode life, the voltage drop can be reduced. Further, by adjusting the diameter and length of the blind holes, the current distribution can be influenced.

The invention claimed is:

1. An anode comprising an anode body with a first stub hole for the insertion of a stub for the connection with a voltage source, the anode comprising at least a first aluminium core and a second aluminium core that are arranged inside the anode body for the connection with the voltage source, wherein a first distance between the first aluminium core and the bottom of the anode is different from a second distance between the second aluminium core and the bottom of the anode.

2. The anode according to claim 1, wherein a length of the first aluminium core is different from a length of the second aluminium core.

3. The anode according to claim 1, wherein the first aluminium core is arranged in a first blind hole of the anode body and the second aluminium core is arranged in a second blind hole of the anode body, wherein the first aluminium core and the second aluminium core are in particular parallel to each other.

4. The anode according to claim 1, wherein the first aluminium core and the second aluminium core are arranged rectangular to the bottom of the anode.

5. The anode according to claim 1, wherein the anode has a cuboid-like shape.

6. The anode according to claim 3, wherein the first blind hole comprising the first aluminium core is sealed by a seal.

7. The anode according to claim 3, wherein an opening of the first blind hole is adjacent to an opening of the first stub hole.

8. The anode according to claim 3, wherein a rotational axis of the first blind hole is parallel to a rotational axis of the first stub hole.

9. The anode according to claim 3, wherein a first notch connects the first stub hole with the first blind hole.

10. The anode according to claim 3, wherein at least a second aluminium core is arranged inside the anode body in a second blind hole.

11. The anode according to claim 10, wherein the first blind hole is longer than the second blind hole.

12. The anode according to claim 10, wherein the first blind hole has a smaller diameter than the second blind hole.

13. The anode according to claim 1, wherein at least one of the following parameters are balanced in order to achieve an optimized current density distribution when used in an aluminium electrolysis process:

a diameter of an aluminium core;

a length of an aluminium core;

an arrangement of the aluminium core in the anode.

14. A method for the manufacture of an anode, in particular for the manufacture of the anode according to claim 1, comprising an anode body with a stub hole for the insertion of a stub for the connection with a voltage source, wherein an aluminium core is arranged inside the anode body for the connection with the voltage source.

15. The anode according to claim 1 for the use in aluminium electrolysis cells.

16. The anode according to claim 6, wherein the seal comprising cast iron.

* * * * *